US005553838A

United States Patent [19]

Lee

[11] Patent Number: 5,553,838

[45] Date of Patent: Sep. 10, 1996

[54] CLAMPING BENCH DOG

[75] Inventor: Leonard G. Lee, Ottawa, Canada

[73] Assignee: Lee Valley Tools Ltd., Ottawa, Canada

[21] Appl. No.: 304,588

[22] Filed: Sep. 12, 1994

Related U.S. Application Data

[63] Continuation-in-part of Ser. No. 816,924, Jan. 3, 1992, Pat. No. Des. 339,728, Ser. No. 927,327, Aug. 10, 1992, Pat. No. 5,275,391, Ser. No. 927,326, Aug. 10, 1992, Pat. No. 5,301,934, Ser. No. 961,489, Oct. 16, 1992, Pat. No. 5,284,311, and Ser. No. 180,031, Jan. 11, 1994, Pat. No. 5,467,972.

[51] Int. Cl.[6] ..... B25B 1/00

[52] U.S. Cl. ..... 269/93; 269/100; 269/900

[58] Field of Search ..... 269/91–94, 238, 269/100, 900, 249; 248/231.9, 221.4

[56] References Cited

U.S. PATENT DOCUMENTS

| | | | |
|---|---|---|---|
| 27,592 | 3/1860 | Cooper | 269/93 |
| 95,337 | 9/1869 | Goulden | 269/91 |
| 97,376 | 11/1869 | Fenner . | |
| D. 271,660 | 12/1983 | Elmore et al. . | |
| D. 318,409 | 7/1991 | Garrett . | |
| 623,175 | 4/1899 | Palmer . | |
| 851,577 | 4/1907 | Weaver | 248/221.4 |
| 1,269,262 | 6/1918 | Crawford . | |
| 1,406,695 | 2/1922 | Staudt . | |
| 1,479,209 | 1/1924 | Topp . | |
| 1,954,708 | 4/1934 | Mass . | |
| 2,560,525 | 7/1951 | Nyl . | |
| 2,877,815 | 3/1959 | Fonken | 269/93 |
| 3,339,912 | 9/1967 | Stack . | |
| 4,084,803 | 4/1978 | Beekenkamp | 269/91 |
| 4,468,018 | 8/1984 | Vaizey . | |
| 4,524,960 | 6/1985 | LePoire . | |
| 4,834,354 | 5/1989 | Yang | 269/249 |
| 4,867,427 | 9/1989 | Cunningham | 269/900 |

FOREIGN PATENT DOCUMENTS

| | | | |
|---|---|---|---|
| 278666 | 10/1914 | Germany | 269/92 |

*Primary Examiner*—Robert C. Watson

*Attorney, Agent, or Firm*—Kilpatrick & Cody

[57] ABSTRACT

A clamping bench dog that provides a simple, economical clamp that may typically be used with conventional round dogs but is also usable with square or rectangular dogs, other clamping dogs and the hold-down described in U.S. Pat. No. 5,275,391. A section of round metal rod provides a clamp body or post that fits into a bench dog hole. A second, threaded rod passes through a threaded hole near the upper end of the post at an angle of approximately eighty-seven degrees (87°) to the axis of the post. A rotatable foot is attached to one end of the threaded rod and can tilt up to about three degrees (3°). A handle, knob or tangent on the other end of the threaded rod is utilized to rotate it, and a wire spring journaled in a longitudinal groove on the post assures that the post will remain fixed in bench top dog holes by pressing against the wall of the hole to increase the friction between the post and wall.

10 Claims, 2 Drawing Sheets

CLAMPING BENCH DOG

This application is a continuation -in-part of patent application Ser. Nos.:

(1) 07/816,924 filed Jan. 3, 1992, now U.S. Pat. No. D339,728, for an "Adjustable Bench Clamp";

(2) 07/927,327 filed Aug. 10, 1992, now U.S. Pat. No. 5,275,391, for a "Bench Hold-Down";

(3) 07/927,326 filed Aug. 10, 1992, now U.S. Pat. No. 5,301,934, for a "Twin Screw Vise";

(4) 07/961,489 filed Oct. 16, 1992, now U.S. Pat. No. 5,284,331, for a "Woodworking Bench System"; and (5) 08/180,031 filed Jan. 11, 1994 for a "Panel Clamping Apparatus," now U.S. Pat. No. 5,467,972.

each of which patents and applications is incorporated herein by this reference.

BACKGROUND OF THE INVENTION

This invention relates to woodworking benches and associated devices for holding workpieces.

WORKBENCHES, BENCH DOGS AND VISES

One of the oldest needs in the field of woodworking is the need to hold a workpiece. Solutions have been developed in great variety throughout the world, although it can be argued that eastern and western woodworking have followed different paths. Eastern woodworking typically uses somewhat simpler devices for holding workpieces, and the woodworker's feet are often directly involved. Western woodworkers typically work standing and have, by contrast, evolved the extensive use of benches on which workpieces are rested and to which they are frequently affixed. Wall illustrations in the Egyptian tomb of Nebanon circa 1450 B.C. depict workbenches, but modern western workbenches have more recent origins documented in German engineering drawings approximately 500 years old. Those drawings show the use of screw-operated tail (or end) and front vises used in conjunction with movable bench dogs to provide a flexible clamping system.

Many of the workbenches well known in the art utilize a substantial top, normally wooden, and one or more bench dogs are often used. Such dogs are typically square or rectangular cross section, wood or metal pins that slide into like-shaped holes located at various positions in the bench top so that the dog can be moved to a desired position. Dogs so positioned in the bench top normally are used to capture a workpiece between the dog and a second dog carried in the movable jaw of a vise mounted at the work bench edge. Traditionally, dogs having square or rectangular cross-sections have been used in dog holes that tilt a few degrees toward the workpiece. More recently round dogs with a face inclined approximately two degrees (2°) relative to their major axis have begun being used in dog holes bored normal to the bench surface.

The need to utilize a woodworking vise in work holding approaches utilizing dogs limits the flexibility of the work holding system and requires the use of a relatively large and expensive vise. The vise is also normally fixed in a particular location on a bench, and this limits the user's ability to orient workpieces on a bench top in positions that do not correspond to the existing vise location.

In part as a result of these limitations, various auxiliary devices have also been developed for holding workpieces, including such devices as hold-downs intended for attachment to a workbench. Additionally, substantial effort has been devoted to the development of devices for clamping workpieces during gluing operations, such as edge-to-edge clamping of boards being glued into panels.

SUMMARY OF THE INVENTION

The clamping bench dog of the present invention provides a simple, economical clamp that may typically be used with conventional round dogs but is also usable with square or rectangular dogs, other clamping dogs and the hold-down described in U.S. Pat. No. 5,275,391. A section of round metal rod provides a clamp body or post that fits into a bench dog hole. A second, threaded rod passes through a threaded hole near the upper end of the post at an angle of approximately eighty-seven degrees (87°) to the axis of the post. A rotatable foot is attached to one end of the threaded rod and can tilt up to about three degrees (3°). A handle, knob or tangent on the other end of the threaded rod is utilized to rotate it, and a wire spring journaled in a longitudinal groove on the post assures that the post will remain fixed in bench top dog holes by pressing against the wall of the hole to increase the friction between the post and wall.

DETAILED DESCRIPTION OF THE DRAWINGS

Clamping Bench Dog

Figure 1:
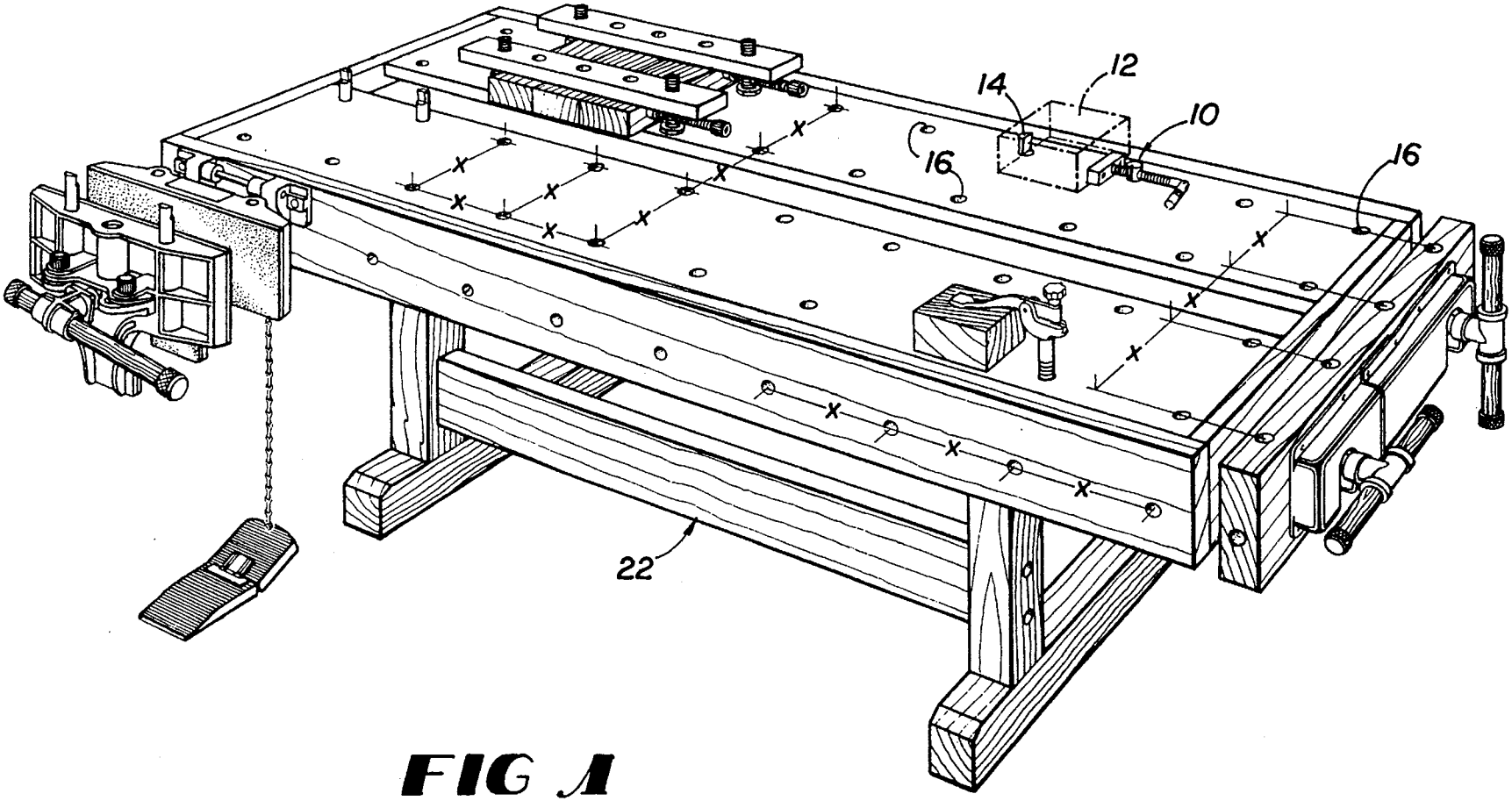
FIG. 1 is a perspective view of a woodworking bench showing the clamping bench dog of the present invention.
Figure 3:
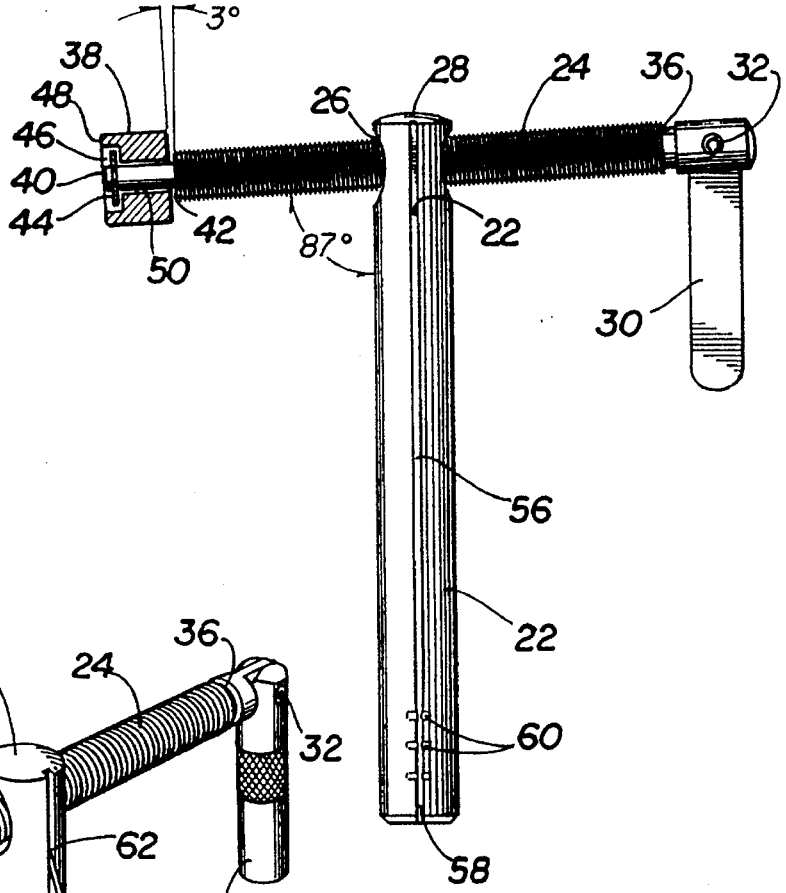
FIG. 3 is a side elevation view of the clamping bench dog shown in FIG. 2 with an alternative tangent for rotating the screw.
Figure 2:
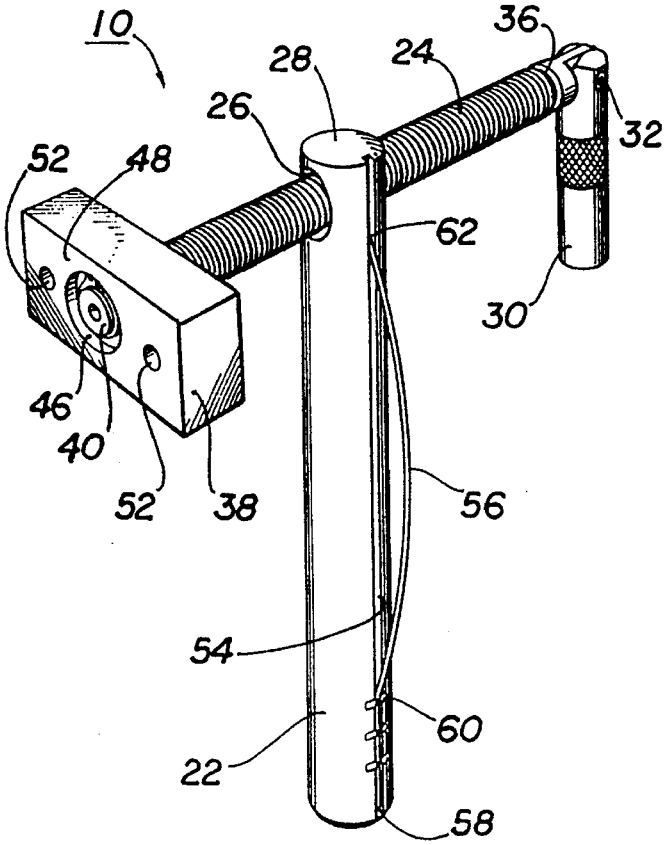
FIG. 2 is a perspective view of the clamping bench dog shown in FIG. 1.

The clamping bench dog 10 of the present invention shown holding a workpiece 12 against a fixed dog 14 in one of holes 16 in bench top 18 of bench 20 in FIG. 1 is illustrated in perspective in FIG. 2 and in elevation in FIG. 3. Clamping bench dog 10 comprises a round post 22 through which a screw 24 is journaled in a threaded hole 26 penetrating the upper end 28 of post 22. Screw 24 may be rotated utilizing a tangent 30 that may be a flat section of plate fixed to pivot in a slot in the end of screw 24 on a pin 32 as illustrated in FIG. 3. Alternatively, and preferably, tangent 30 is formed of a short section of round rod and is attached to pivot on pin 32 that passes through one end 36 of screw 24 transverse to its major axis. Tangent 30 desirably carries knurling so that it may be easily spun between the user's thumb and forefinger when it is oriented along the major axis of screw 24 in order to rapidly rotate screw 24. Alternatively, by pivoting tangent 30 at right angles to screw 24, it may be used as a moment arm that facilitates exertion of substantial force to rotate screw 24. Clamping pad 38, which may typically be a short rectangular section of brass, steel or other appropriate material, is attached to the end 40 of screw 24 opposite tangent 30. Such attachment may be accomplished by a variety of conventional methods. In the method illustrated in FIGS. 2 and 3, end 40 of screw 24 is turned to a reduced diameter so that a shoulder 42 is formed, and an annular depression is formed near the end 40 to receive a split clamping ring 44 that seats within a recess 46 in the face 48 of pad 38, which recess 46 may be a blind bore coaxial with and larger in diameter than hole 50. Holes 52 in pad 38 facilitate the attachment to pad 38 of auxiliary (typically wood) jaws in a wide variety of shapes to facilitate use of clamping bench dog 10 in holding irregularly shaped objects and to protect such objects from damage resulting from direct contact with pad 38. For instance, a vee-shaped auxiliary face may be attached to pad 38 in order to clamp a round object.

Clamping pad 38 should be of sufficient width that a force exerted on the workpiece 12 parallel to the bench top 18 and perpendicular to screw 24 will not easily cause clamping dog 10 to pivot or rotate, despite the limited "play" between clamping pad 38 and screw 24 described below.

The surface of post 22 is typically smooth, but a longitudinal groove 54 positioned at ninety degrees (90°) from the axis of screw 24 receives a wire spring 56, one end of which 58 will typically be swaged in the groove 54 as shown at 60. The other end 62 of spring 56 remains free to slide in groove 54 as spring 56 is compressed against post 22 when post 22 is inserted in a hole 16 in bench 20. It is important that the axis of hole 26, and therefore the longitudinal axis of screw 24 when it is journaled in threaded hole 26, not be at ninety degrees (90°) to the longitudinal axis of post 22. Instead, by locating the axis of hole 26 a few degrees off of ninety degrees (90°) (at, for instance, eighty-seven degrees (87°)), screw 24 may be inserted through post 22 so that the pad end 40 of screw 24 is slightly closer to bench top 18 during use than the tangent end 36 of screw 24, with the result that pad 38 exerts pressure against workpiece 12 that includes a vector normal to bench top 18, thereby tending to force workpiece 12 not only against dog 14 but against bench top 18 as well. Such downward inclination of screw 24 also compensates for the inevitable canting of post 22 within hole 16 when pressure is exerted on the workpiece 12, thereby reducing the possibility that such pressure will include a vector away from the bench top 18 and that the workpiece 57 will be lifted from contact with bench top 18.

In order to facilitate seating of pad 38 squarely against workpiece 57 even though screw 24 may be slightly canted relative to the workpiece 57 or the workpiece 12 itself may have an inclined face, it is desirable for pad 38 to "wobble" a few degrees on the end of screw 24, such as approximately three degrees (3°), as illustrated in FIG. 3. This may be easily accomplished simply by making the reduced diameter end 40 of screw 24 sufficiently smaller than the hole 50 in pad 38 through which it passes to result in appropriate "play" between pad 38 and the end 40 of screw 24.

The foregoing description of this invention is for the purposes of explanation and illustration. It will be apparent to those skilled in the art that modification and changes may be made to this invention without departing from the scope and spirit of the preceding description and the following claims.

We claim:

1. A clamping bench dog comprising:

a. a post having two ends, a longitudinal axis, and a threaded bore near one the ends of the post located on an axis rotated approximately eighty-seven degrees (87°) from the post longitudinal axis, b. a screw having two ends and journaled in the through-bore, c. a pad rotatably fixed on one of the ends of the screw, f. means on the other end of the screw for rotating the screw, and g. means for increasing friction between the post and a dog hole within which it is positioned.

2. The clamping dog of claim 1, wherein the screw rotating means is a handle pivotably attached to the other end of the screw.

3. The clamping dog of claim 2, wherein the handle is a section of round rod substantially the same diameter as the screw.

4. The clamping dog of claim 1, wherein the post is round and the friction increasing means is a wire spring having two ends, one of which ends is fixed to the post.

5. The clamping bench dog of claim 1, wherein the pad is tiltably fixed on the end of the screw.

6. A clamping bench dog, comprising:

a. a post having two ends, a longitudinal axis and a threaded bore near one of the ends of the post located on an axis rotated approximately eighty-seven degrees (87°) from the post longitudinal axis, b. a screw having two ends and journaled in the threaded bore, c. a pad rotatably fixed on one of the ends of the screw, d. means on the other end of the screw for rotating the screw, and e. means for increasing friction between the post and the dog hole within which it is positioned, wherein the post is round and the friction increasing means is a wire spring having two ends, one of which ends is fixed to the post.

7. The clamping dog of claim 6, wherein the screw rotating means is a handle pivotably attached to the other end of the screw.

8. The clamping dog of claim 7, wherein the handle is a section of round rod substantially the same diameter as the screw.

9. The clamping dog of claim 8, wherein the pad is tiltably fixed on the end of the screw.

10. The clamp of claim 8, wherein at least a portion of the surface of the rod is knurled.

* * * * *